United States Patent [19]

Nausedas

[11] 4,335,559

[45] Jun. 22, 1982

[54] DUAL PRESSURE CLOSURE CLIPPING SYSTEM FOR CHAMBER EVACUATOR

[75] Inventor: Joseph A. Nausedas, Oak Forest, Ill.

[73] Assignee: Union Carbide Corporation, Danbury, Conn.

[21] Appl. No.: 100,172

[22] Filed: Dec. 4, 1979

[51] Int. Cl.[3] ..... B65B 31/02; B65B 51/02

[52] U.S. Cl. ..... 53/138 A; 29/243.56; 53/512

[58] Field of Search ..... 53/417, 434, 138 A, 53/512; 29/33.5, 243.56

[56] References Cited

U.S. PATENT DOCUMENTS

| | | | |
|---|---|---|---|
| 2,886,928 | 5/1959 | Pearce | 53/512 X |
| 3,570,088 | 3/1971 | Klenz | 53/138 A |
| 3,714,754 | 2/1973 | Holcombe | 53/138 A |
| 3,832,824 | 9/1974 | Burrell | 53/512 X |

*Primary Examiner*—John Sipos

*Attorney, Agent, or Firm*—Maurice W. Ryan

[57] ABSTRACT

A dual pressure closure clipping system for use on chamber evacuators used in vacuum packing articles in flexible plastic bags provides high pressure for small bags and low pressure for large bags closure clipping actions, selectable according to evacuation times.

3 Claims, 4 Drawing Figures

DUAL PRESSURE CLOSURE CLIPPING SYSTEM FOR CHAMBER EVACUATOR

BACKGROUND OF THE INVENTION

The packaging industry, food packaging particularly and more specifically the meat packing industry, has greatly benefited and advanced by the development and use of vacuum packaging techniques. The extraction of air from bagged meat product articles, for example, is a recognized and practiced prerequisite to the heat shrinking of heat shrinkable plastic packaging bags used in modern day poultry packaging and in "boxed beef" techniques, where primal cuts of meat, up to about forty or so pounds, random in size and shape, are bagged, evacuated, clip closed, and the bag heat shrunk to produce a packaged meat article which is easily handled for shipment, storage and ultimate use, with only less than freezing refrigeration conditions required rather than freezing for the preservation of the product.

The major criteria for effective vacuumizing of plastic bagged articles are that all possible air in the bag, with the article in place therein, including entrained air in crevices, folds and interstices in the meat article itself, be removed from the bag, that closure of the bag be effected while the bag interior is in its optimum vacuumized condition, and that the closure be complete, and continually made sequentially on bags of varying and assorted sizes in process, without damaging the bags structural integrity.

Other criteria include reliability of the apparatus, consistent reproducibility of results, ease of maintenance, cleanliness, ease of operation, and production speed capability.

Towards the attainment of these criteria and objectives, one of the vacuumizing systems developed and used involves first vacuumizing a closed zone in which a bagged article is disposed and then subsequently vacuumizing the bag itself independently. Typical apparatus for vacuumizing systems used in packaging articles in flexible bags according to this technique is described in U.S. Pat. No. 3,714,754 to Holcombe et al and U.S. Pat. No. 3,832,824 to Burrell, the descriptive teachings of which are incorporated herein by reference.

The vacuumizing packaging technique described in the aforesaid U.S. patent references comprehends an apparatus arrangement which includes a power driven belt conveyor, a vacuum hood, a vacuum source, clip closure means, motive means to actuate the conveyor, hood, and clip closure means, and operating and control components controllably interconnecting these elements. In operation, articles to be packaged are placed in open-mouthed plastic film packaging bags which are in turn placed on the conveyor, advantageously in an oriented manner through the use of jigs or product guides on the conveyor at regular spaced intervals. The articles on the conveyor are moved until one or more of them are located beneath the vacuum hood, at which time, the conveyor is stopped, the vacuum hood is lowered into sealing seating contact with the conveyor, the zone formed by the hood and the conveyor is evacuated, the bag interior is evacuated, the clip closure is applied while the bag interior is held at maximum vacuumized condition, vacuum is released, the hood raised and the bagged clip-closed article or articles moved from under the hood while the next item in sequence is simultaneously conveyed thereunder.

Alternatively, and as illustrated in the '824 patent, a short conveyor belt system may be contained completely within a vacuum chamber disposed between input and output conveyor elements. In this arrangement the seating seal is formed between the vacuum chamber hood which, when lowered, impinges on the chamber lower or body portion which completely contains the bagged article in place therein.

The two stage vacuumizing technique requires means to access the bag interiors to a vacuum connection. In the '754 patent this is accomplished by neck-gathering the open mouth of the bag around an extractor conduit and holding the necked-down bag folds in place thereon with scissor-like clamping elements. In the '824 patent, bag interior vacuumizing is accomplished by means of a second chamber within the vacuum chamber, separated from the main chamber by a wall. The bagged article resides in the main chamber while the mouth portion of the bag is gathered and held in necked-down pleated but unsealed condition.

In all of the known vacuumizing packaging techniques to which the present invention has applicability, the final closure of the bag in process is effected by a clipping device which crimps closed a metal clip tightly around the necked-down gathered folds of the bag material at the bag mouth. The clip closing mechanism is disposed at or adjacent the point where the bag material is gathered and held in its aforedescribed condition, and comprehends a magazine type supply source of clips arranged for one at a time dispensing and use, a clip drive attached to a hydraulically actuated rod connected to a hydraulic piston, hydraulic piston cylinder means, a clip crimping anvil juxtaposed to the clip drive, and hydraulic actuating means controllably connected to the control system of the vacuumizing equipment and arranged to drive and crimp close a clip around the gathered bag material upon completion of a preselected time of bag evacuation. Alternatively, the clip closing mechanism may be pneumatically actuated rather than hydraulically actuated.

In either case the clip closure action is initiated in each cycle when the vacuum level inside the bag in process reaches a preselected level and this, in turn, is governed by a time period in the control arrangement selected according to the size bag being evacuated. The evacuation period is known in the industry as the "soak time" and varies with bag size, longer soak times being required to effectively vacuumize larger bags, and shorter soak times for smaller bags.

THE PROBLEM

Experience in using the aforedescribed apparatus has shown that a single invariable closure clipping pressure force used with varying bag sizes can yield undesireable results. It has been found by meat packers using the aforedescribed evacuators that a lower clip closing force should be used to properly close the clips on large size bags, say in the 22 to 24 inch flat widths, than for small size bags, of say, 10 or 12 inch flat widths. The reason for this is that the gathered pleated plastic material at the bag necks to be clip closed presents a larger cross sectional area for large bags than for small bags. When the same size clip is used, as is and must be the practical case, with the same full clip closure, effected by the same full clip closure force, the larger bags have experienced physical damage to the film by the metal clip tearing and puncturing it, causing a faulty bagged article called a "leaker". Since the closure at the bag neck must be seal tight after clipping, leakers, to the extent that they are detected, must be pulled out of the production line and reworked. Undetected leakers result in product spoilage. A solution to this problem has been sought, prior to the time of the present invention, by manually interposing control action into the operating sequence to apply less clip closing force on the larger bags so that each large bag clip is bent or crimped only as far as required to effect bag sealing, and not crimped completely around with full pressure which can cause the aforedescribed damage to the bag material.

The smaller bags, on the other hand, present less cross sectional area of bag material to be clip closed, and full clip crimping force is required to bend the clip all the way around the bag neck. Thus the clips for smaller bags must be closed more tightly to encompass a smaller area of gathered bag material than the clips for larger bags which need not be so fully and tightly crimped to effectively seal the larger areas of gathered bag material which they encompass, and, indeed, should not be fully crimped lest the bags be damaged as described hereinabove.

Prior to the time of the present invention, efforts to solve the problem and provide two levels of closure clip crimping pressure have not brought about any significantly satisfactory results. On commercially used evacuators similar to that described in U.S. Pat. No. 3,832,824, for instance, a source of control air pressure is regulated manually to vary hydraulic pressure which determines the clip closing force. The actual clip application and crimping is accomplished by force from a hydraulic booster with a 30:1 ratio. One practice used is to set the control air pressures by a manually operated regulator for a range of approximately 54–56 psi for large size bags to 58–62 psi for the small size bags. In many instances however the actual practice is to set the regulator at one mid-level pressure as a compromise for all bag sizes, large and small. This practice can really compound the problem since some small bags may not be clip closed tightly enough, and some larger bags may be damaged by clips too tightly crimped around the bag material.

OBJECTIVES AND SUMMARY OF THE INVENTION

With this then being the state of the art, the present invention was conceived and developed to provide for the application of selectably different levels of clip closure force to seal vacuumized or evacuated bags containing articles being packaged, the force depending upon the bag size.

The invention also provides for the application of a closure clip crimping force which is lower for larger bags being clip closed and higher for smaller bags.

A further advantage and feature of the invention is the application of closure clip crimping force which is larger for smaller bags and smaller for larger bags in accordance with the time, known as the soak time, required to attain a preselected vacuum level in the bag being evacuated.

A still further advantage of the invention is that it can be readily adapted to equipment presently used in food packaging operations which use packaging evacuators, most particularly the meat packing industry.

These and other features and advantages of the invention will be the more readily appreciated and understood from the general and detailed description of the invention set forth hereinafter and with reference to the appended drawing wherein.

Figure 1:
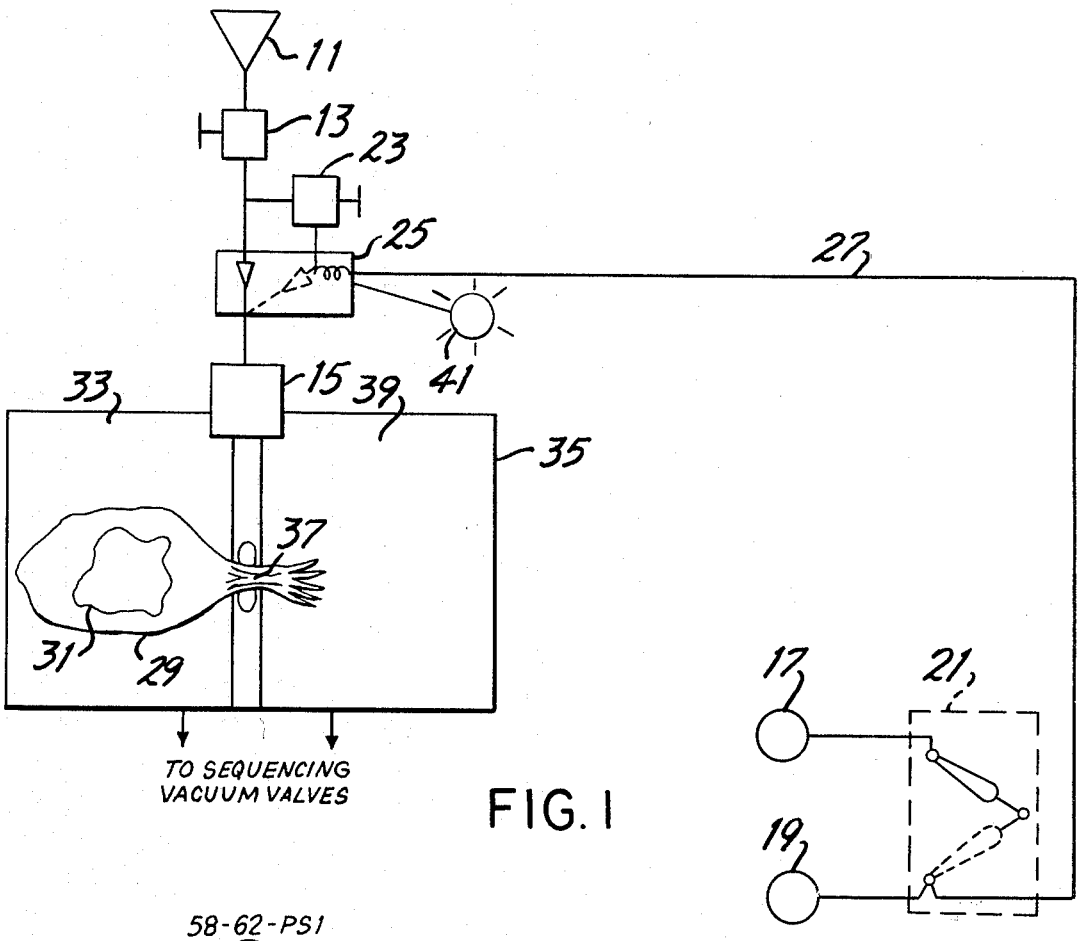
FIG. 1 is a schematic diagram of apparatus of the present invention installed on a dual chamber evacuator.

In general, the method of the present invention is for varying clip closure pressure on clips crimped around gathered bag material in a vacuum packaging operation and comprises controllably varying the clip closure pressure from a high pressure sufficient to effect seal-tight clip closure encompassing of the gathered bag material of the smallest of the range of bags used in the operation, to a low pressure sufficient to effect seal tight clip closure encompassing of the gathered bag material of the largest of the range of bags used in the operation, inversely according to the times required to attain preselected vacuum levels interior of respective bags in process being clip closed.

More specifically, the method of the invention is advantageously practiced by having an elapsed first time period corresponding to the time required to reach a preselected vacuum condition interior of a small bag in process initiate control action to effect application of high clip closing pressure, and an elapsed second time period corresponding to the time required to reach a preselected vacuum condition interior of a large bag in process initiate control action to effect application of low clip closing pressure.

In the practical and preferred mode of practicing the method of the invention, the preselected vacuum condition interior of the small bag and the preselected vacuum condition interior of the large bag are equal.

As to apparatus, the invention comprehends apparatus to provide selectable dual level closure pressure for a fluid actuated, fluid controlled, clip closure component of a vacuum packaging mechanism for evacuation of varying sized plastic film packaging bags containing articles being package, said vacuum packaging mechanism having at least two timer elements connected to provide for controllable selection of a longer evacuation time for larger bags and a shorter evacuation time for smaller bags in process, which apparatus comprises, in combination: an electrical solenoid operated control valve connected in the fluid control system of the clip closure component, having first and second inlets selectably internally connectable to an outlet; fluid connection means extending between a control fluid pressure source and the first inlet of said control valve; a pressure regulator connected between said control fluid pressure source and the second inlet of said control valve, set to a pressure output less than that of said control fluid pressure source; connection means between the outlet of said control valve and the fluid actuating system of the clip closure component; and electrical circuit means between the timer elements and the electrical solenoid operated control valve, operably connected to place the control fluid pressure source in operable communication with the fluid actuating system of the clip closure component when a shorter evacuation time timer is in circuit, and to place the pressure regulator in operable communication with the fluid actuating system of the clip closure component when a longer evacuation time timer is in circuit.

Preferred embodiments of apparatus according to the invention include the aforedescribed apparatus arrangement in combination with a fluid control system and a fluid actuating system of the clip closure component which are separate systems and the connection means between the outlet of the control valve and the fluid actuating system of the clip closure component includes an inter system pressure booster.

A particularly preferred and practical embodiment of the present invention uses a pneumatic control valve in a pneumatic control system and wherein the pressure regulator is also a pneumatic pressure regulator.

DESCRIPTION OF THE INVENTION

With reference to the drawing, FIG. 1 illustrates schematically the operation of the invention on a two vacuum evacuating chamber bag closure device. Control system air is supplied from an air supply source 11 at nominal plant air pressure of say 80 psi to a pressure regulator 13. Pressure regulator 13 is set to reduce its plant air inlet pressure and maintain its outlet pressure at approximately 58–62 psi, a pressure found suitable to effect full and satisfactory clip closure and crimping for small bags. Regulated air pressure from regulator 13 is directed through a by pass passage in valve 25 to an air over oil booster of clipper component 15. The hydraulic side of the booster supplies pressurized oil which provides the force to drive and crimp close the clip about the gathered neck material of the bag. Timers 17 and 19 are provided in the basic evacuator apparatus to selectably control the soak times for the bags being vacuumized, timer 17 being selected by positioning control switch 21 in circuit therewith to effect a short time evacuating cycle or soak time for small bags. The control switch 21 is positioned in circuit with timer 19 for a long soak time for large bags, selectably, according to the operators choice.

The apparatus elements of the present invention are a second pressure regulator 23, electrical solenoid operated valve 25, and an electrical circuit 27 extending between the timer control switch 21 and the valve 25. The electrical solenoid operated valve 25 is interposed in the air pressure control line extending between the regulator 13 outlet side and the clipper component 15 air over oil booster. With the solenoid deenergized the valve 25 permits flow through of air pressure required to effect full clip closure and crimping on small bags. The regulator 23 is of the self relieving type, and is connected between the first regulator 13 outlet side and an inlet of the valve 25. The solenoid of valve 25 is energized when the timer selector control switch 21 is put in circuit with the long soak timer 19 for large bags and actuates the valve to cut off air from regulator 13 and connect air from regulator 23. Regulator 23 is set to supply a lower control pressure, approximately 54–56 psi, to the clipping component booster, causing the clip application and closure crimping to be effected with less force than that applied in closing small bags with the air pressure control from regulator 13. The solenoid operated valve may advantageously be provided with a pilot light 41.

In operation, a bag 29 containing a product 31 is placed in the main chamber 33 of evacuator 35 with the gathered neck 37 of the bag held in position between the chamber 33 and chamber 39 of evacuator 35 in registration with the clipper component 15, the bag interior prior to clipping being open to chamber 39.

Closing the evacuator 35 hood on both chambers 33,39, initiates the sequencing of the vacuum valves (not shown) to vacuumize the bag as described hereinabove and in the U.S. patents hereinbefore referenced.

At the conclusion of the vacuumizing period as determined by either of the timers 17, 19, bag clipping action is initiated and completed with a force commensurate with the bag size and soak time selected by the operator, that is to say, with full closure and crimping force for small bags when timer 17 is in circuit and control air pressure is supplied from regulator 13, and lesser force for larger bags when timer 19 is in circuit, the solenoid valve 25 is energized, and control air pressure is supplied from regulator 23. Thus the air pressure for controlling the clipping force is automatically selected when the time for evacuating the bag, according to its size, is selected.

EXAMPLE

Figure 2:
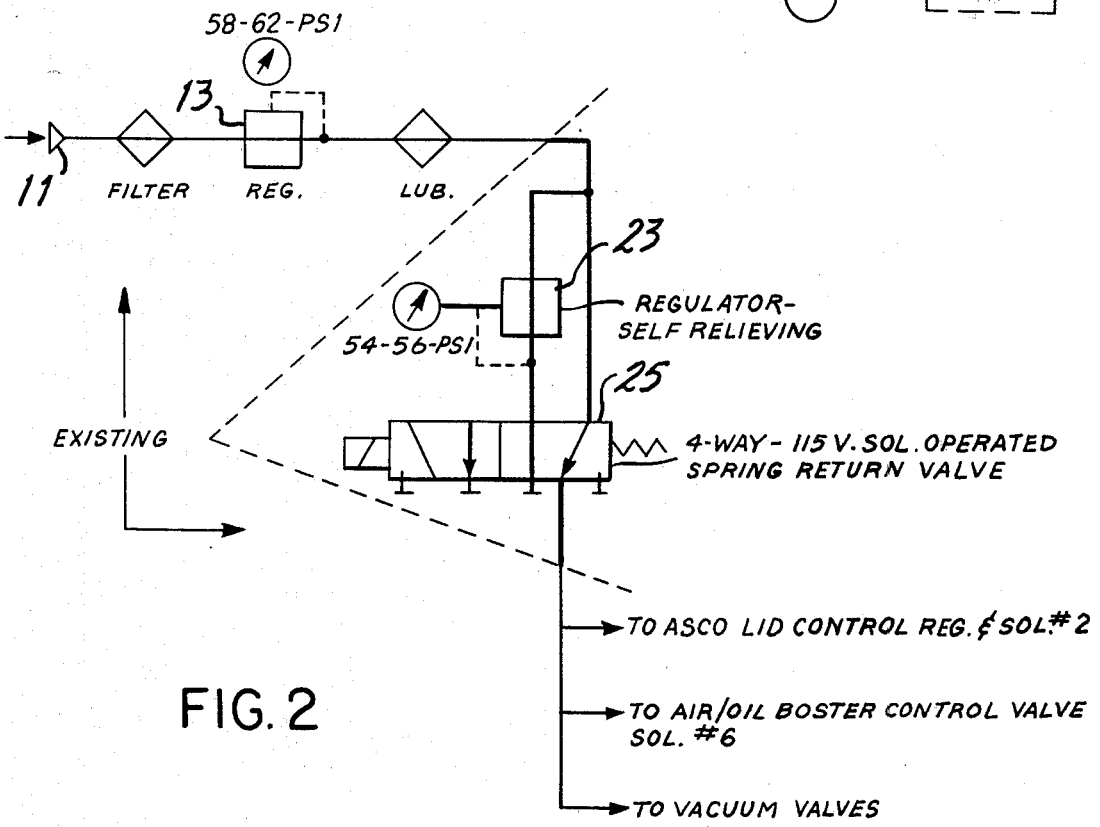
FIG. 2 is a schematic diagram of a preferred embodiment of apparatus according to the invention.

In a practical working embodiment of the invention a Cryovac model 8200 dual chamber evacuator was modified to operate in accordance with and with apparatus of the invention. FIG. 2 of the drawing shows the schematic arrangement of this preferred embodiment and mode of practicing the invention. The self relieving regulator 23 selected is a Ross No. 5212A2007, ¼", 0–60 psi pressure regulator; the solenoid operated control valve 25 is a Ross No. W7016A2311 direct solenoid operated spring return 4-way valve, 115 volt, 60 cycle, with indicator light 41, connected to light when the solenoid is energized; a glycerine filled pressure gauge 43 is provided on the pressure regulator 23, UCC No. UC3923 0–60 psi; all assembled and connected with appropriate hardware, fittings, conduits, tubing and electrical connections as shown schematically in FIG. 2, where the parts comprising the invention are drawn full weight lined and the existing components on the model 8200 evacuator, to the extent that they bear relevance in coacting with the present invention are drawn light weight lined.

Figure 3:
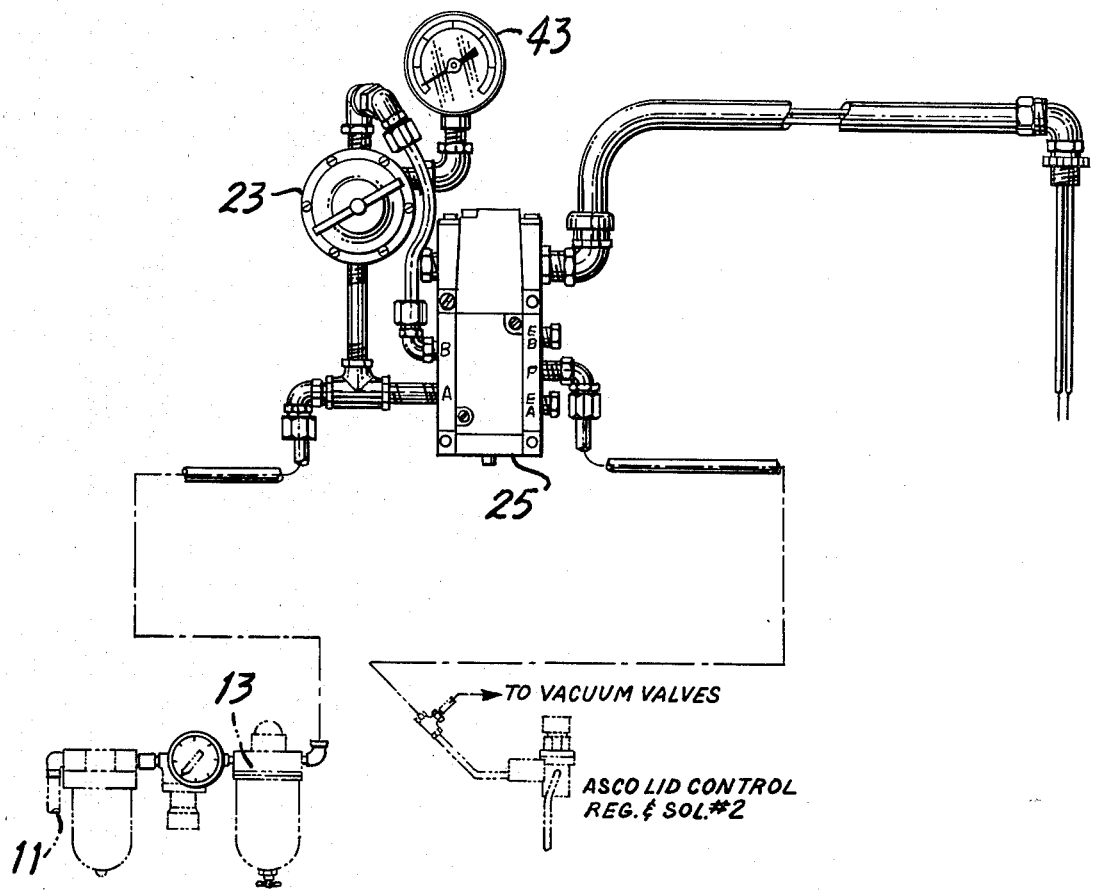
FIG. 3 is an elevational view of a preferred embodiment of apparatus according to the invention.
Figure 4:
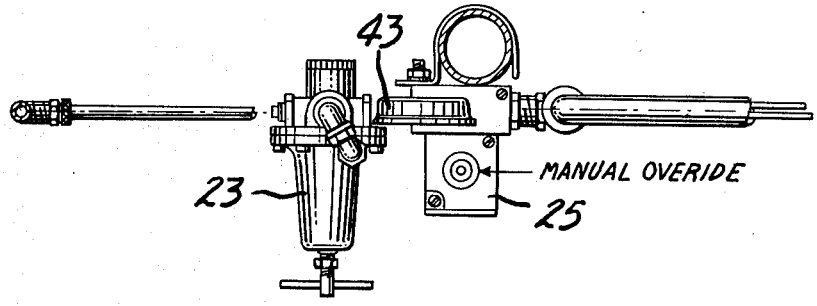
FIG. 4 is a plan view of the apparatus of FIG. 3.

FIGS. 3 and 4 show the physical arrangement of the apparatus of this embodiment of the invention as shown schematically in FIG. 2.

The description of the invention presented hereinabove is for illustrative purposes and should not be construed in any limiting sense, the invention being defined in the appended claims.

What is claimed is:

1. Apparatus to provide selectable dual level closure pressure for a fluid actuated, fluid controlled, clip closure component on a vacuum packaging mechanism for evacuation of varying sized plastic film packaging bags containing articles being packaged, said vacuum packaging mechanism having at least two timer elements connected to provide for controllable selection of a longer evacuation time for larger bags and a shorter evacuation time for smaller bags in process, said apparatus comprising, in combination:

an electrical solenoid operated control valve connected in the fluid control system of the clip closure component, having first and second inlets selectably internally connectable to an outlet;

fluid connection means extending between a control fluid pressure source and the first inlet of said control valve;

a pressure regulator connected between said control fluid pressure source and the second inlet of said control valve, set to a pressure output less than that of said control fluid pressure source;

connection means between the outlet of said control valve and the fluid actuating system of the clip closure component; and electrical circuit means between the timer elements and the electrical solenoid operated control valve, operably connected to place the control fluid pressure source in operable communication with the fluid actuating system of the clip closure component when a shorter evacuation time timer is in circuit, and to place the pressure regulator in operable communication with the fluid actuating system of the clip closure component when a longer evacuation time timer is in circuit.

2. Apparatus according to claim 1 in combination with a fluid control system and a fluid actuating system of the clip closure component which are separate systems and the connection means between the outlet of said control valve and the fluid actuating system of the clip closure component includes an inter system pressure booster.

3. Apparatus according to claim 1 wherein the electrical solenoid operated control valve is a pneumatic valve and the pressure regulator is a pneumatic pressure regulator connected in a pneumatic control system.

* * * * *